United States Patent [19]

Clark

[11] 4,392,373

[45] Jul. 12, 1983

[54] FORMING MEANS

[75] Inventor: Richard J. Clark, Auckland, New Zealand

[73] Assignee: Fisher & Paykel Limited, Auckland, New Zealand

[21] Appl. No.: 171,421

[22] Filed: Jul. 23, 1980

[30] Foreign Application Priority Data

Jul. 27, 1979 [NZ] New Zealand ..... 191145

[51] Int. Cl.[3] ..... B21D 11/04

[52] U.S. Cl. ..... 72/321; 72/384; 72/387

[58] Field of Search ..... 72/319–322, 72/384, 387, 388

[56] References Cited

U.S. PATENT DOCUMENTS

| | | | |
|---|---|---|---|
| 1,520,419 | 12/1924 | Jones . | |
| 1,963,900 | 6/1934 | Harvey et al. | 72/388 |
| 2,336,105 | 12/1943 | Lilja . | |
| 3,191,419 | 6/1965 | Rippe . | |
| 3,777,529 | 12/1973 | Kaufmann et al. . | |
| 3,908,433 | 9/1975 | Helzer | 72/388 |
| 3,948,074 | 4/1976 | Stalzer . | |
| 3,983,735 | 10/1976 | Berry | 72/320 |
| 3,994,152 | 11/1976 | Wolters | 72/319 |
| 4,043,165 | 8/1977 | Badger et al. . | |

FOREIGN PATENT DOCUMENTS

| | | |
|---|---|---|
| 1163931 | 10/1958 | France . |
| 2364709 | 4/1978 | France . |
| 161362 | 7/1933 | Switzerland . |
| 7593 | of 1902 | United Kingdom . |

*Primary Examiner*—Leon Gilden
*Attorney, Agent, or Firm*—Spencer & Kaye

[57] ABSTRACT

A forming machine to form a sheet of metal to an "S" bend having clamps to clamp the sheet metal, one of the clamps having an anvil about which the sheet metal is folded by a rotatable forming bar to form a first channel and partially form a second channel in the sheet metal after which the rotatable bar is moved clear and a nose on a further former further folds the second channel facing in the opposite direction to the first channel.

2 Claims, 2 Drawing Figures

FORMING MEANS

BACKGROUND OF THE INVENTION

This invention relates to forming means.

SUMMARY OF THE INVENTION

It is an object of the present invention to provide a forming means which will at least provide the public with a useful choice.

Accordingly in one aspect the invention consists in a method of forming a substantially S shaped formation in a sheet of metal, said method comprising the steps of clamping the sheet of metal in position relative to a fixed anvil which defines the profile of one concavity of the S shaped formation, rotating a shaped former about its axis to cause part of the sheet of metal to conform to the shape of said anvil, and to cause a further part of the sheet of metal to be moved towards the nose of a further former during the rotation of said rotatable forming former, moving the rotatable former clear and moving said further former in a manner such as to form a second concavity facing in the opposite direction to the first to form said substantially S shaped formation in said sheet of metal.

In a further aspect the invention consists in a forming means for forming a substantially S shaped formation in sheet metal, said forming means comprising clamping means which in use clamp sheet metal to hold it in position, a fixed anvil, a shaped rotatable forming member which in use forms a first channel in said sheet metal by folding the metal about part of said anvil, a movable forming member having a shaped nose positionable relative to said anvil and said rotatable forming means to a form a second opposite facing channel, rotating means to rotate said rotatable forming member through a desired arc of rotation from and to a rest position and moving means to move said movable forming means through a desired range of movement to and from a rest position, the construction and arrangement being such that in use a sheet of metal is clamped by said clamping means and part of the sheet of metal is formed to said first channel by rotation of said rotatable forming member, part of the sheet of metal contacting the nose of said movable forming member after which said rotatable forming member is moved clear and said movable forming member moved to form said second opposite facing channel to complete the forming of the sheet of metal resulting in a substantially S shaped formation in the sheet of metal.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which.

DESCRIPTION OF THE PREFERRED EMBODIMENTS

Figure 1:
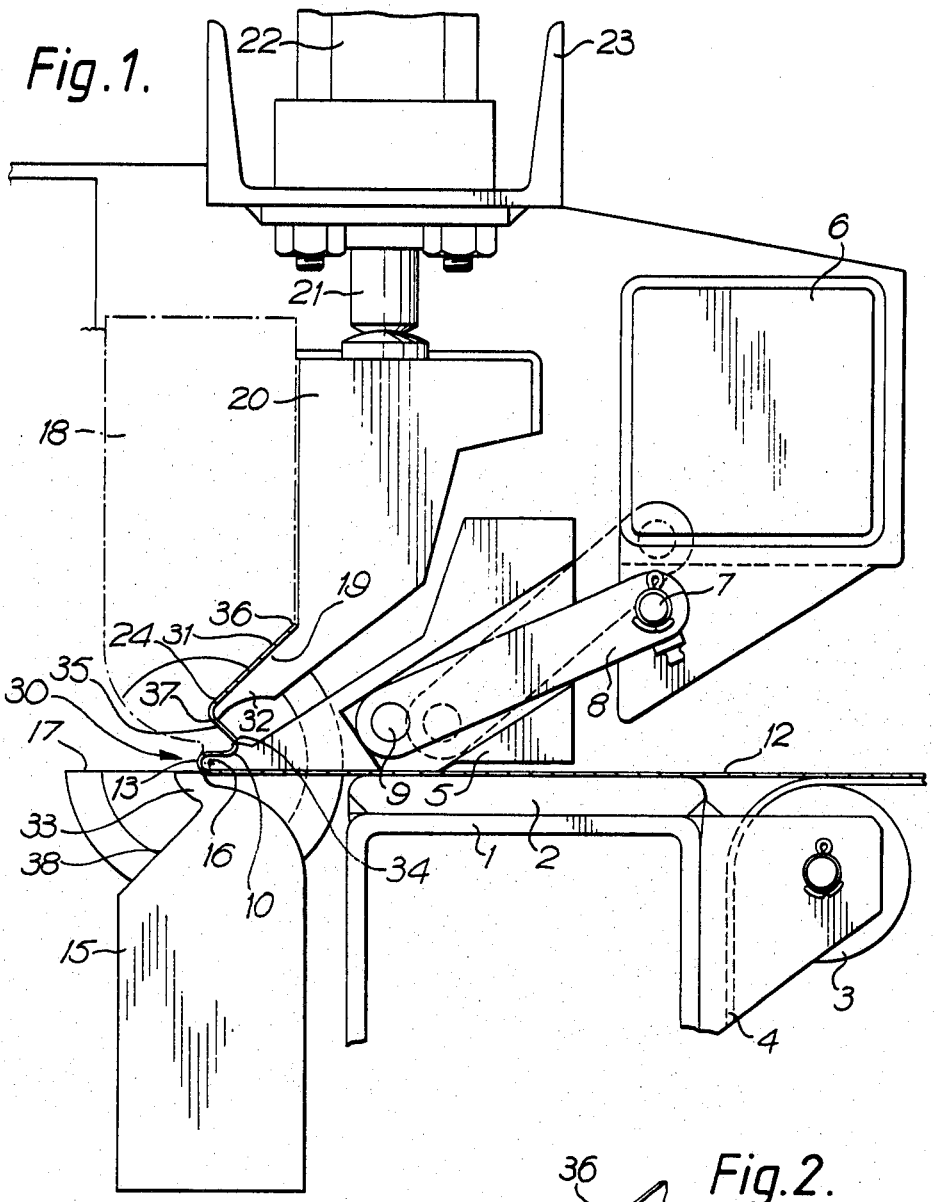
FIG. 1 is a side elevational view of a forming machine according to the invention.
Figure 2:
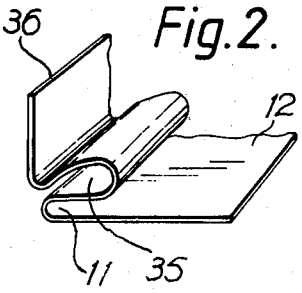
FIG. 2 is a perspective sketch of part of a sheet of metal folded according to the invention.

Referring to the drawings, a forming machine according to the invention is shown in part in FIG. 1 and comprises frame members of which the RHS section 1 forms part, such RHS section carrying a clamping member 2. Rollers 3 which may be driven by a driving flexible member 4 are provided to feed a sheet of metal into position relative to the clamping member 2. A further clamping member 5 is provided movable by a movable RHS member 6 having a pivot 7 connected to a link 8, the link 8 being connected by a pivot 9 to the clamping member 5. The clamping member 5 has an anvil 10 shaped to provide a first concavity or channel 11 in the sheet of metal 12 (FIG. 2). A shaped rotatable forming bar 15 is rotatable on its axis 16 there being a suitable trunnion 17 disposed one at each end of the rotatable forming bar 15. This bar rotates through approximately 180° to the position shown in pecked lines at 18 (FIG. 1).

A further movable forming bar 20 is provided movable, for example, by a rod or series of rods 21 actuated by hydraulic piston and cylinder arrangements shown in part at 22. These rods are mounted on a channel member 23. The movable member 20 has a shaped nose 24 and is movable in a translatable manner through a small amount of movement as will be described further later.

The operation of the constructions is a follows:

A sheet of metal, for example, to form the wrapper of a white goods casing e.g. a refrigerator casing is advanced by the roller 3 until in a suitable position when it is stopped by a stop means (not shown) contacting the forward end of the sheet of metal. The clamping member 5 is then clamped onto the sheet of metal with the nose 10 holding the sheet of metal at the position where the first channel 11 is to be made. The rotatable forming bar 15 is then rotated from the position shown in full lines in FIG. 1 to the further position shown in pecked lines at 18. During this movement the initial forming of the sheet of metal 30 is simply one of folding the metal around the beak or anvil 10 of the clamping member 5 with the shoulder 19 forming the metal onto the beak 32 of movable member 20, thus setting the free end 36 of the sheet metal relative to the flange 37 of the second channel. However on the sheet of metal attaining the position shown at 31, the flange 37 will contact the beak 32 of member 20 and the nose 33 will then press the metal eventually into the shape shown at 34 (FIG. 1) through interaction of beaks 32 and nose 33. When the bar 15 attains the position shown in pecked lines at 18, the bar 15 is then returned to its position in full lines or at least so that the nose 33 is clear of the beak 32 and the movable member 20 is then moved downwardly and forwardly to close the sheet metal until a further concavity or channel 35 (FIG. 2) is formed in the sheet metal and the part 36 of the sheet metal previously positioned by shoulder 38 is substantially at right angles to the main part of the sheet metal 12 which is still held between the clamping members 5 and 2. If desired the rotatable member 15 is rotated until the nose 33 is suitably positioned to assist in locating the flange 37 substantially at right angles. The movable member 20 is then withdrawn and the clamp 5 released so that the sheet of metal can again be driven by the moving roller 3 together with the other rollers if necessary, the operation being complete.

It will be seen that the above apparatus forms a substantially S shaped formation quickly and effectively.

What is claimed is:

1. A sheet bending apparatus for forming a substantially S shaped formation in a piece of sheet metal comprising clamping means for holding the piece of sheet metal;

a single surface shaped to provide a first bend in the piece of sheet metal;

a first forming means rotatable about an axis between a first position and a second position for bending the sheet metal to conform to a portion of said single anvil surface to form a first, 180° bend in the piece of sheet metal; and a second forming means linearly displaceable towards said single anvil surface from a third position to a fourth position for forming a second bend in the piece of sheet metal to complete the S shaped formation in the piece of sheet metal.

2. A sheet bending apparatus for forming a substantially S-shaped formation in a piece of sheet metal comprising clamping means for holding the piece of sheet metal;

an anvil shaped to provide bends in the piece of sheet metal and having adjacent first and second portions;

a rotating forming bar having an angled shoulder and a shaped nose; said rotating forming bar being rotatable about an axis between a first position and a second position; said shaped nose of said rotating forming bar cooperating with said first portion of the anvil for bending the piece of sheet metal to conform to said first portion of said anvil to form a first, 180° bend in the piece of sheet metal when said rotating forming bar moves into said second position; said second portion of said anvil cooperating with said nose of said rotary forming bar to form an initial bend in the piece of sheet metal adjoining said first bend when said rotating forming bar moves into said second position;

and a linearly movable forming bar having an angled shoulder and beak and being linearly displaceable towards said anvil from a third position to a fourth position; said angled shoulder of said rotary forming bar cooperating with the angled shoulder of said linearly displaceable forming bar to position therebetween a length of the piece of sheet metal adjoining said initial bend and remote from said first bend when said rotary forming bar moves into said second position; and said beak of said linearly movable forming bar further deforming said initial bend to complete the S-shaped formation of the piece of sheet metal when said linearly movable forming bar is moved into said fourth position.

* * * * *